US011085212B2

(12) United States Patent
Rivaya

(10) Patent No.: US 11,085,212 B2
(45) Date of Patent: Aug. 10, 2021

(54) SELECTIVELY CONCEALED DOOR HANDLE

(71) Applicant: Ford Global Technologies, LLC, Dearborn, MI (US)

(72) Inventor: Jorge Suarez Rivaya, Mountain View, CA (US)

(73) Assignee: Ford Global Technologies, LLC, Dearborn, MI (US)

( * ) Notice: Subject to any disclaimer, the term of this patent is extended or adjusted under 35 U.S.C. 154(b) by 535 days.

(21) Appl. No.: 16/044,873

(22) Filed: Jul. 25, 2018

(65) Prior Publication Data

US 2020/0032560 A1 Jan. 30, 2020

(51) Int. Cl.

| | |
|---|---|
| ***E05B 85/10*** | (2014.01) |
| ***E05B 81/76*** | (2014.01) |
| ***E05B 81/78*** | (2014.01) |

(52) U.S. Cl.

CPC ..... *E05B 85/103* (2013.01); *E05B 81/77* (2013.01); *E05B 81/78* (2013.01); *E05B 85/107* (2013.01)

(58) Field of Classification Search

CPC ..... E05B 85/103; E05B 81/77; E05B 81/78; E05B 85/107; E05B 5/00; E05B 5/006; E05B 77/34; E05B 77/32; E05B 81/76; E05B 1/00; E05B 13/00; E05B 7/00; E05B 77/00; E05B 79/00; E05B 81/00; E05B 85/10; Y10T 292/57; Y10T 70/00; Y10T 292/00; Y10S 292/31; Y10S 292/04; Y10S 292/30; B60R 25/01

See application file for complete search history.

(56) References Cited

U.S. PATENT DOCUMENTS

| | | | | |
|---|---|---|---|---|
| 7,108,301 | B2 * | 9/2006 | Louvel | E05B 81/78 292/201 |
| 8,443,553 | B1 | 5/2013 | Polewarczyk et al. | |
| 8,701,353 | B2 | 4/2014 | Patel et al. | |

(Continued)

FOREIGN PATENT DOCUMENTS

| | | |
|---|---|---|
| CN | 106437348 | 2/2017 |
| CN | 206503456 | 9/2017 |

(Continued)

OTHER PUBLICATIONS

Oxford English Dictionary, Flange, Lexico.com, Jan. 27, 2021 (Year: 2021).*

(Continued)

*Primary Examiner* — Kristina R Fulton
*Assistant Examiner* — Emily G. Brown
(74) *Attorney, Agent, or Firm* — David Coppiellie, Esq.; Carlson, Gaskey & Olds, P.C.

(57) ABSTRACT

An exemplary motor vehicle assembly includes a handle concealing assembly rotatable back and forth between a concealing position that blocks access to a door handle and a revealing position that permits access to the door handle. The door handle is separate from the handle concealing assembly. An exemplary method includes, among other things, rotating a handle concealing assembly back and forth between a concealing position that blocks access to a door handle and a revealing position that permits access to the door handle. The door handle is separate from the handle concealing assembly.

18 Claims, 3 Drawing Sheets

(56) References Cited

U.S. PATENT DOCUMENTS

| | | | | |
|---|---|---|---|---|
| 8,943,752 | B2 * | 2/2015 | Thomas | E05B 81/78 49/394 |
| 9,518,410 | B2 * | 12/2016 | Vasi | E05B 85/103 |
| 2009/0079207 | A1 * | 3/2009 | Manzhura | E05B 85/107 292/336.3 |
| 2012/0119524 | A1 * | 5/2012 | Bingle | E05B 81/78 292/336.3 |
| 2014/0069015 | A1 * | 3/2014 | Salter | E05B 81/76 49/31 |
| 2015/0330112 | A1 * | 11/2015 | Van Wiemeersch | E05B 81/76 292/201 |
| 2019/0234121 | A1 * | 8/2019 | Pudney | E05B 81/78 |

FOREIGN PATENT DOCUMENTS

| | | | | |
|---|---|---|---|---|
| DE | 3835265 | A1 * | 4/1990 | E05B 81/10 |
| DE | 102012112611 | | 7/2014 | |
| JP | 2003221960 | A * | 8/2003 | |
| KR | 100572059 | B1 * | 4/2006 | E05B 81/10 |
| KR | 100931160 | | 12/2009 | |
| KR | 20130063124 | | 6/2013 | |

OTHER PUBLICATIONS

Merriam-Webster.com, Notch, Merriam-Webster, Jan. 27, 2021 (Year: 2021).*

* cited by examiner

SELECTIVELY CONCEALED DOOR HANDLE

TECHNICAL FIELD

This disclosure relates generally to a door handle for a motor vehicle that can be selectively concealed, and a method of using the same.

BACKGROUND

Motor vehicles are known to include doors with handles, which are pulled in order to open the door. Typically, the handles are coupled to a cable or rod. When the handle is pulled, the cable or rod actuates a latch mechanism, which allows the user to open the door.

Vehicles can include handles on both the exterior and the interior of the door. Some known exterior handles protrude outward from the exterior of the door when in an unpulled state (i.e., a resting position), and have a recess beneath the handle to accommodate a user's hand. Some other known exterior handles are flush with the exterior of the door and then pop out to a position where the user can grasp the exterior handle. Such handles can be difficult to move through a build-up of ice and snow. Further, such handles may not be durable enough to withstand multiple pulls of the door to the open position over time.

SUMMARY

A motor vehicle assembly according to an exemplary aspect of the present disclosure includes a handle concealing assembly rotatable back and forth between a concealing position that blocks access to a door handle and a revealing position that permits access to the door handle. The door handle is separate from the handle concealing assembly.

In a further non-limiting embodiment of the foregoing assembly, the handle concealing assembly is recessed beneath an exterior surface of the door body when in the revealing position and when in the concealing position.

A further non-limiting embodiment of any of the foregoing assemblies includes a door body that includes the door handle.

In a further non-limiting embodiment of any of the foregoing assemblies, the door handle is a downwardly extending flange of the door body.

A further non-limiting embodiment of any of the foregoing assemblies includes an aperture provided by the door and an open area provided by the handle concealing assembly. The aperture and the open area are at least partially aligned in the revealing position. The aperture and the open area are misaligned in the concealing position.

In a further non-limiting embodiment of any of the foregoing assemblies, the handle concealing assembly is rotatable about an axis between the revealing position and the concealing position. The aperture and the open area are at least partially circumferentially aligned relative to the axis when in the revealing position. The aperture and the open area are circumferentially misaligned relative to the axis when in the concealing position.

In further non-limiting embodiment of any of the foregoing assemblies, an axial cross-section of the handle concealing assembly is oval with a notch to provide the open area.

A further non-limiting embodiment of any of the foregoing assemblies includes a sensor assembly configured to detect a user.

A further non-limiting embodiment of any of the foregoing assemblies includes a sensor assembly disposed on an inwardly facing surface of the door handle.

A further non-limiting embodiment of any of the foregoing assemblies includes a sensor assembly configured to authorize a user.

A method according to another exemplary aspect of the present disclosure includes, among other things, rotating a handle concealing assembly back and forth between a concealing position that blocks access to a door handle and a revealing position that permits access to the door handle. The door handle is separate from the handle concealing assembly.

In further non-limiting embodiment of the foregoing method, the handle concealing assembly is recessed behind an exterior surface of the door body when in the revealing position and when in the concealing position.

In further non-limiting embodiment of any of the foregoing methods, the door handle is a portion of a door body.

In further non-limiting embodiment of any of the foregoing methods, the door handle is a downwardly extending flange of the door body.

A further non-limiting embodiment of any of the foregoing methods includes aligning an aperture provided by the door and an open area provided by the handle concealing assembly when in the revealing position, and misaligning the aperture and the open area when in the concealing position.

A further non-limiting embodiment of any of the foregoing methods includes misaligning the aperture and the open area when in the concealing position such that a portion of the handle concealing assembly blocks the aperture.

A further non-limiting embodiment of any of the foregoing methods includes transitioning a door latch from a latched position to an unlatched position in response to detecting a presence of a user.

A further non-limiting embodiment of any of the foregoing methods includes transitioning a door latch from a latched position to an unlatched position in response to detecting of an authorized user.

A further non-limiting embodiment of any of the foregoing methods includes rotating the handle concealing assembly from the concealing position to the revealing position in response to detecting a key.

The embodiments, examples and alternatives of the preceding paragraphs, the claims, or the following description and drawings, including any of their various aspects or respective individual features, may be taken independently or in any combination. Features described in connection with one embodiment are applicable to all embodiments, unless such features are incompatible.

BRIEF DESCRIPTION OF THE FIGURES

The various features and advantages of the disclosed examples will become apparent to those skilled in the art from the detailed description. The figures that accompany the detailed description can be briefly described as follows.

DETAILED DESCRIPTION

This disclosure relates to a selectively concealed door handle for a motor vehicle, and a method of using the same.

A handle concealing assembly is rotatable back and forth between a revealing position that permits access to a door handle and a concealing position that blocks access to the door handle. The door handle is separate from the handle concealing assembly.

In some examples, the door handle concealing assembly is recessed relative to an exterior surface of a door body when the handle concealing assembly is in the revealing position and when the handle is the concealing position. The recessing can provide a relatively smooth surface across the exterior surface of the door body, which can lead to aerodynamic improvements and can enhance aesthetics. Electrified vehicles can, in particular, benefit from aerodynamic improvements as a range of the electrified vehicle can be increased if aerodynamic resistance is reduced.

In some examples, the door body provides the door handle, such as a downwardly extending flange of the door body. One benefit of this arrangement is that a user pulls a relatively strong component when moving the door from a closed position to an open position.

Figure 1:
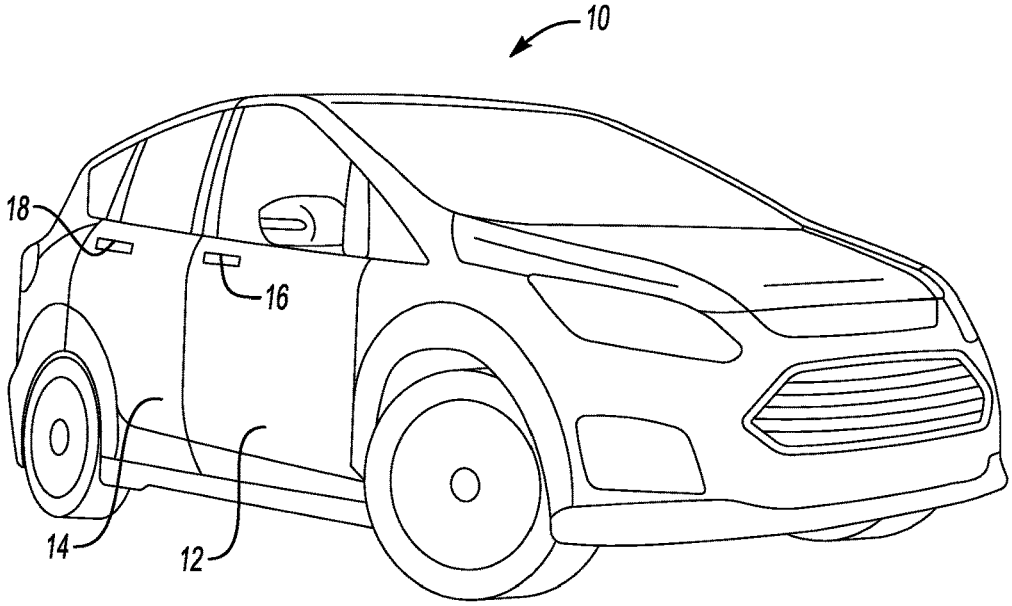
FIG. 1 illustrates a perspective view of an exemplary motor vehicle.

FIG. 1 is a perspective view of a motor vehicle 10. The motor vehicle 10 is an electrified vehicle and, in this example, a four door sedan. FIG. 1 shows a front passenger door 12 and a rear passenger door 14. Each of the doors 12, 14 include a door handle 16, 18. Provided the door handle 16 is accessible and the front passenger door 12 is unlatched, a user can pull the door handle 16 to move the front passenger door 12 from the closed position shown to an open position. The user can access a passenger compartment of the vehicle 10 when the front passenger door 12 is in the open position. Similarly, provided the handle 18 is accessible and the rear passenger door 14 is unlatched, a user can pull the handle 18 to move the rear passenger door 14 from the closed position shown to an open position.

While a sedan is shown in FIG. 1, it should be understood that the disclosure extends to all vehicle types, including cars, trucks, vans, sport utility vehicles (SUVs), etc. Further, while a four door vehicle is shown in FIG. 1, this disclosure extends to vehicles having at least one door.

Figure 2:
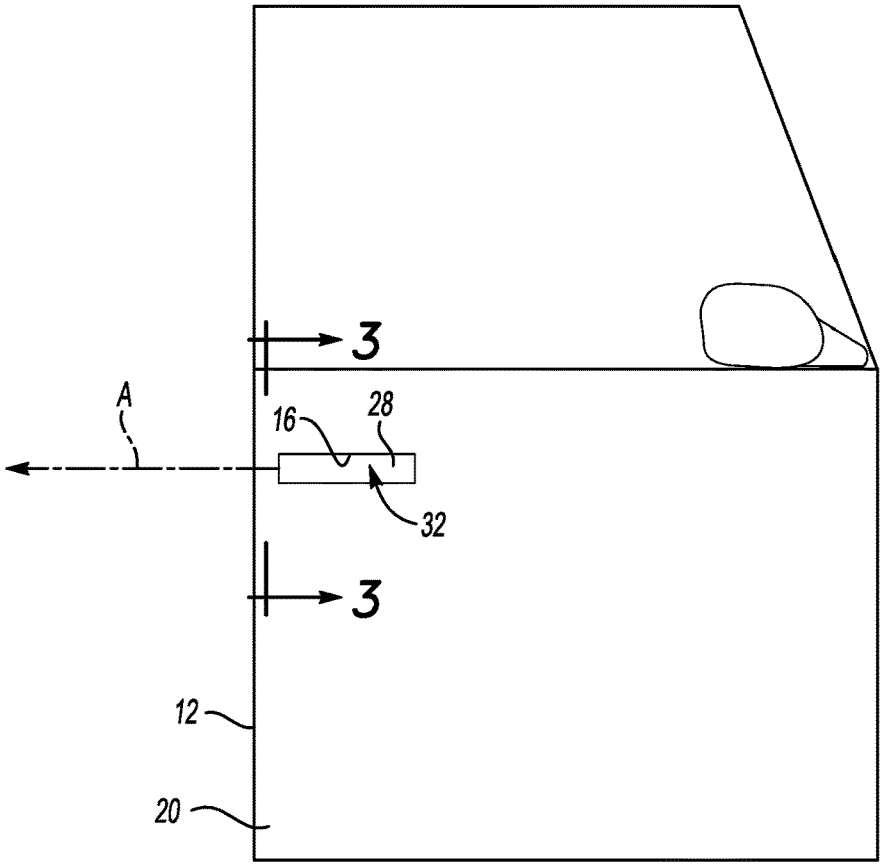
FIG. 2 is a side view of a front passenger door from the vehicle of FIG. 1 having a handle concealing assembly in a concealing position where a door handle is substantially inaccessible to a user.
Figure 3:
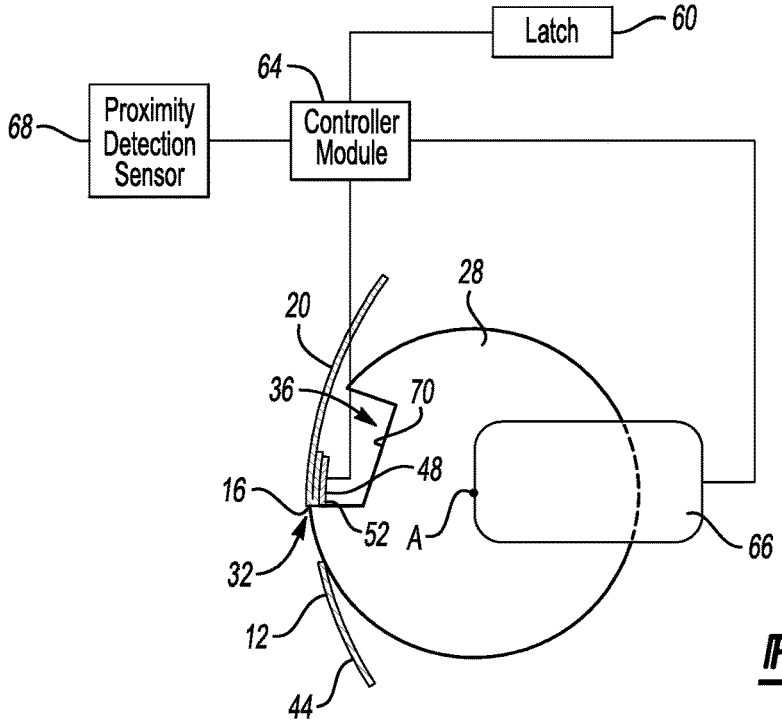
FIG. 3 illustrates a section view taken at line 3-3 in FIG. 2.
Figure 4:
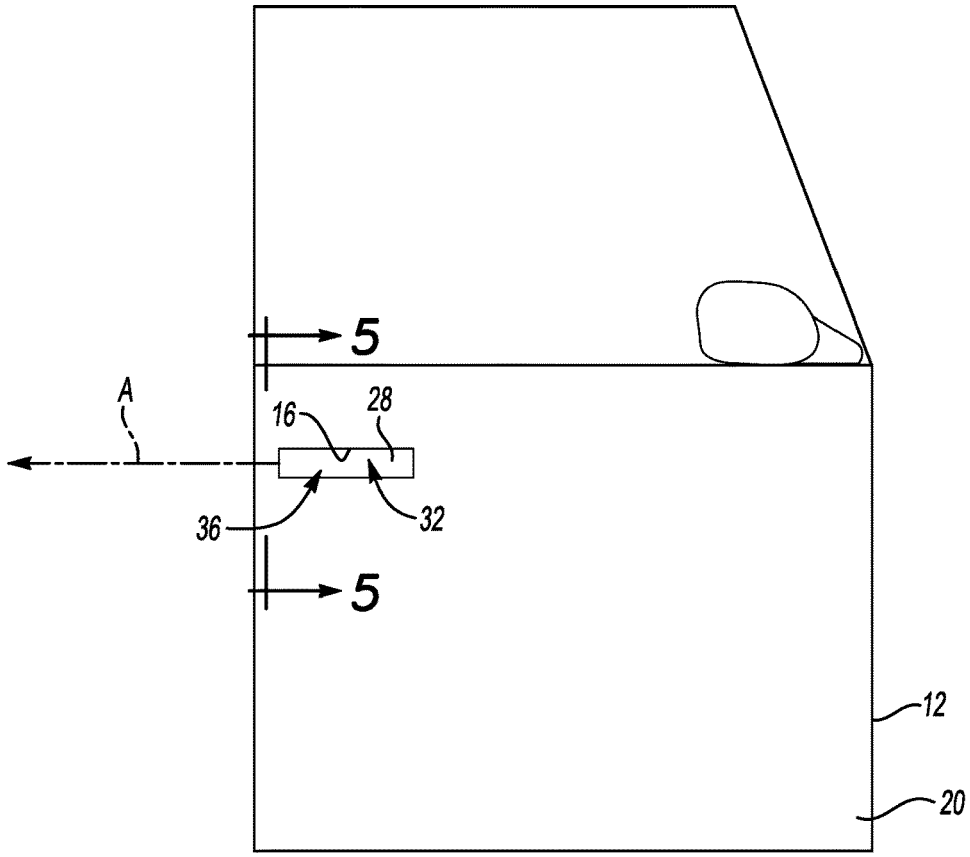
FIG. 4 illustrates a side view of the door of FIG. 2 with the handle concealing assembly in a revealing position where the door handle is substantially accessible to the user.

With reference now to FIGS. 2-4, the front passenger door 12 includes the door handle 16 as part of a door body 20, and a handle concealing assembly 28 separate from the door body 20. In the exemplary non-limiting embodiment, the door handle 16 is a downwardly extending flange of the door body 20.

The rear passenger door 14 of FIG. 1 can be configured similarly to the front passenger door 12.

Figure 5:
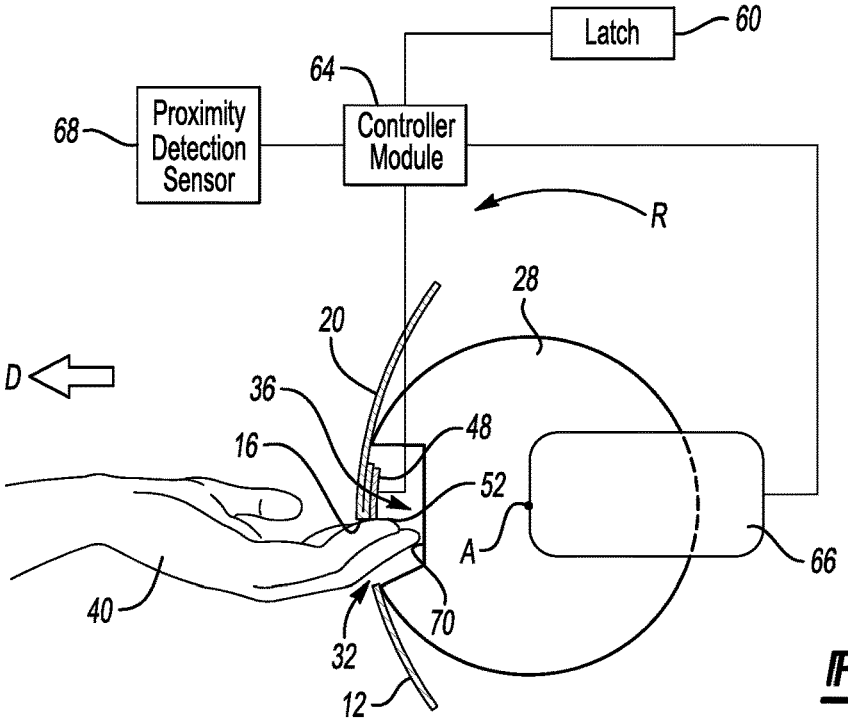
FIG. 5 illustrates a section taken at line 5-5 in FIG. 4.

The handle concealing assembly 28 is rotatable between the concealing position of FIGS. 2 and 3, and the revealing position of FIGS. 4 and 5. In the concealing position, the handle concealing assembly 28 blocks an aperture 32 within the door body 20. Rotating the handle concealing assembly 28 about an axis A in a direction R can move the handle concealing assembly 28 to the revealing position of FIGS. 4 and 5. In the revealing position, an open area 36 of the handle concealing assembly 28 is circumferentially aligned with the aperture 32 such that the handle concealing assembly 28 no longer blocks the aperture 32. A user can then insert their hand 40 through the aperture 32 to grasp the door handle 16.

When the handle concealing assembly 28 is in the concealing position, the open area 36 is circumferentially offset from the aperture 32. When in the concealing position, the handle concealing assembly 28 blocks the user's hand 40 from moving through the aperture 32. Also, when in the concealing position, the handle concealing assembly 28 visually fills the aperture 32. An outer surface 44 of the door body 20 and the handle concealing assembly 28 then appear as a substantially smooth surface when viewed from an exterior of the vehicle 10, which can be visually appealing for some vehicle styles and can reduce aerodynamic drag.

When the handle concealing assembly 28 is rotated to the revealing position of FIGS. 4 and 5, at least a portion of the open area 36 circumferentially overlaps with the aperture 32 to permit the user's hand 40 to move through the aperture 32. The user's hand 40 can then grasp an inwardly facing surface 48 of the door handle 16 to pull the door 12 in a direction D (FIG. 5) to the open position.

Notably, forces associated with the user pulling the door handle 16 are directed primarily into the door body 20 rather than, for example, the handle concealing assembly 28. The door body 20 may be better able to withstand these forces than the handle concealing assembly 28. The door body 20 can be aluminum, for example.

The inwardly facing surface 48 of the door handle 16 faces the handle concealing assembly 28. At least one sensor 52 can be mounted to the inwardly facing surface 48. In an exemplary embodiment, the sensor 52 can detect the presence of the user's hand 40, which may trigger a controller module 64 of the vehicle 10 to actuate a door latch 60 of the door 12. Actuating the door latch 60 can unlatch the door 12 so that the forces applied by the user when pulling the door handle 16 can cause the door 12 to open.

The sensor 52 could be a presence detecting sensor, such as a capacitance based sensor, that can detect the user's hand 40 near the sensor 52. The presence of the user's hand 40 can cause the controller module 64 to transition the door latch 60 so that the door 12 can be opened.

The sensor 52 could instead, or additionally, be a pressure sensor. The user's hand 40 grasping such the sensor 52 applies pressure to the sensor 52 triggering the controller module 64 to transition the door latch 60 so that the door can be opened.

The sensor 52 could be used to confirm and identity of the user. In such examples, the sensor 52 could be a biometric sensor, such as a fingerprint sensor. If such a sensor is used, the user may be required to be an authorized user to trigger the transition of the door latch 60 so that the door 12 can be opened. Such the sensor can ensure that the user's hand 40 is not only present, but is also the hand of a user that is authorized to open the vehicle 10. In this example, if an unauthorized user grasps the door handle 16, the fingerprints of the unauthorized user are not authenticated and the door latch 60 holding the door 12 continues to hold the door 12 in a closed position.

The handle concealing assembly 28 can be rotated back and forth between the concealing position and the revealing position by an actuator 66. Those skilled in the art and having the benefit of this disclosure could understand an actuator suitable for rotating the handle concealing assembly 28.

The controller module 64 can be operable coupled to the actuator 66 to selectively command the actuator 66 to move to the handle concealing assembly 28 concealing position or to the revealing position. The controller module 64, in some examples, can command the actuator 66 to move the handle concealing assembly 28 from the concealing position to the revealing position in response to a signal indicating that the user is proximate the door 12.

The vehicle 10 could include, for example, a proximity detection sensor 68 in communication with the controller module 64. When the proximity detection sensor 68 detects a key within a given distance from the vehicle 10, a signal is communicated to the controller module 64. The key can be a key fob, or another device granting access to the vehicle 10, that is carried by the user. The controller module 64 interprets the signal as the user being near the vehicle 10, and then triggers the door handle concealing assembly 28 to move from the concealing position of FIGS. 2 and 3 to the revealing position of FIGS. 4 and 5. In another example, the signal is sent to the controller module 64 from the user interacting with an application on a portable device, such as a touchscreen telephone. In yet another example, the signal is sent in response to a user within the passenger compartment pulling an interior handle of the door 12.

Keeping the door handle concealing assembly 28 in the concealing position until movement to the revealing position is authorized can, among other things, enhance security as the door handle 16 cannot be grasped.

Notably, the presence of the user may not cause the door latch 60 associated with the door 12 to unlatch and permit opening of the door 12. Instead, further verification of the user may be required, such as by the biometric sensor. The further verification could be activated and deactivated by altering settings of the vehicle 10, for example.

In this example, the handle concealing assembly 28 remains recessed behind the outer surface 44 of the door body 20 when in the revealing position and when in the concealing position. In other examples, some portion of the handle concealing assembly 28 could extend through the aperture 32 past the outer surface 44.

The exemplary door handle concealing assembly 28, as shown in FIGS. 3 and 5, is cylindrical and has an axial cross-section that is oval, but for a notch 70 that provides the open area 36. In some examples, the door handle concealing assembly 28 has an axial cross-section that is circular. In other examples, the axial cross-section of the handle concealing assembly 28 is oval.

The controller module 64 that receives the signals could be a microcontroller unit (MCU). The controller module 64 could include a single controller or portions of a plurality of different controllers. The controller module 64 could be, or could include, and Engine Control Unit (ECU) of the vehicle 10.

The controller module 64 can include, among other things, a processor and a memory portion. The processor can be programmed to execute a program stored in the memory portion. The processor can be a custom made or commercially available processor, a central processing unit (CPU), an auxiliary processor among several processors associated with the controller module, a semi-conductor based microprocessor (in the form of a microchip or chipset) or generally any device for executing software instructions.

The memory portion can include any one or combination of volatile memory elements. The program can be stored in such the memory portion as software code. The programs can include one or more additional or separate programs, each of which includes an ordered list of executable instructions for implementing logical functions associated with rotating the handle concealing assembly 28 between concealing and revealing positions, and with transitioning the door lock 60 between locked and unlocked states.

Figure 6:
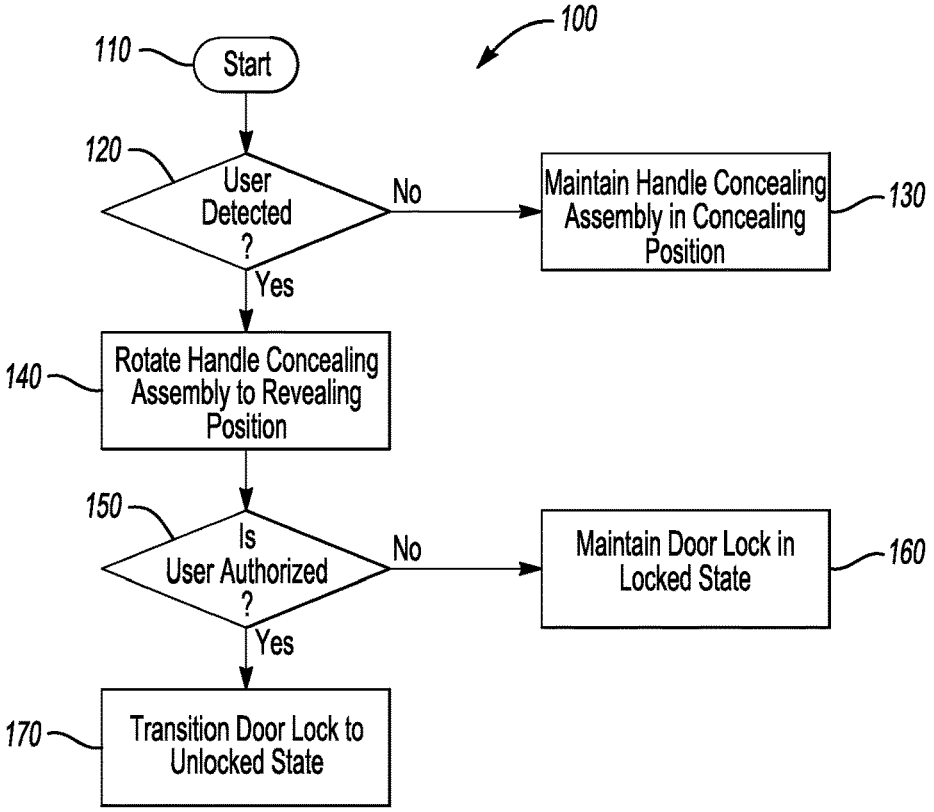
FIG. 6 illustrates the flow of an exemplary method of using the door handle assembly of FIGS. 2-5.

Referring now to FIG. 6, a flow of an example method 100 of using the handle assembly described in connection with FIGS. 2-5 could be utilized by the controller module 64. The method 100 begins at step 110 wherein the door 12 is latched in a closed position and the handle concealing assembly 28 is in the concealing position.

Next, the method 100 moves to a step 120, which assesses whether or not a user is proximate the vehicle 10. If a user is not detected, the handle concealing assembly 28 is maintained in the concealing position as shown at step 130. If a user is detected, the method 100 moves to a step 140 where the handle concealing assembly 28 is rotated from the concealing position to the revealing position.

From the step 140, the method 100 moves to a step 150, which assesses whether the user is authorized to open the door 12. The user may be required to contact the door handle 16 to authorize the user. Authorization could utilize, for example, the biometric sensor as previously was described.

If the user is not authorized to open the door 12, the method moves to a step 160, which maintains the door latch 60 in the locked state. If the user is authorized to open the door 12, the method 100 moves to the step 170, which transitions the door latch 60 to an unlatched state. The user can then pull the door handle 16 to open the door 12. The step 170, in some examples, could additionally include the vehicle 10 automatically pushing the door 12 outward away from the closed position.

In some examples, authorization at the step 150 is not required and the door latch 60 is transitioned to the unlatched state in response to the sensor 52 detecting the hand 40 within the open area 36 using a presence sensor or a pressure sensor.

After the user has closed the door 12 and is within, for example, the passenger compartment of the vehicle 10, the controller module 64 can transition the handle concealing assembly 28 back to the concealing position. The controller module 64 could also transition the handle concealing assembly 28 back to the concealing position in response to the user leaving an area proximate the vehicle 10.

Features of the disclosed examples include concealing a door handle of a vehicle door until using the door handle is required. Another feature of the disclosed examples can include authenticating a user prior to permitting the user to open the vehicle door using the door handle. The door handle can be portion of the door body rather than the door concealing assembly. The door body may provide a more durable handle than the rotatable door concealing assembly.

Although the different examples have the specific components shown in the illustrations, embodiments of this disclosure are not limited to those particular combinations. It is possible to use some of the components or features from one of the examples in combination with features or components from another one of the examples. In addition, the various figures accompanying this disclosure are not necessarily to scale, and some features may be exaggerated or minimized to show certain details of a particular component or arrangement.

One of ordinary skill in this art would understand that the above-described embodiments are exemplary and non-limiting. That is, modifications of this disclosure would come within the scope of the claims. Accordingly, the following claims should be studied to determine their true scope and content.

What is claimed is:

1. A motor vehicle assembly, comprising:

a handle concealing assembly rotatable back and forth between a concealing position that blocks access to a door handle and a revealing position that permits access to the door handle, the door handle separate from the handle concealing assembly, the handle concealing assembly providing an open area; and a door body having an aperture, wherein the handle concealing assembly is rotatable about an axis between the revealing position and the concealing position, wherein at least a portion of the open area circumferentially overlaps with the aperture about the axis when the handle concealing assembly is in the revealing position, wherein the aperture and the open area are circumferentially offset from each other when the handle concealing assembly is in the concealing position wherein the door handle is a downwardly extending flange of the door body, wherein the downwardly extending flange and the open area circumferentially overlap when the handle concealing assembly is in the revealing position.

2. The motor vehicle assembly of claim 1, wherein the handle concealing assembly is recessed beneath an exterior surface of the door body when in the revealing position and when in the concealing position, wherein, when the handle concealing assembly is in the revealing position, the open area opens laterally outward.

3. The motor vehicle assembly of claim 1, wherein an axial cross-section of the handle concealing assembly is oval with a gap to provide the open area, the gap opening radially outward away from the axis.

4. The motor vehicle assembly of claim 3, wherein the gap includes a floor and radially extending sidewalls.

5. The motor vehicle assembly of claim 3, wherein an axial cross-section of the handle concealing assembly is circular.

6. The motor vehicle assembly of claim 1, further comprising a sensor assembly configured to detect a user.

7. The motor vehicle assembly of claim 1, further comprising a sensor assembly disposed on an inwardly facing surface of the door handle.

8. The motor vehicle assembly of claim 1, further comprising a sensor assembly configured to authorize a user.

9. The motor vehicle assembly of claim 1, wherein the aperture and the open area are circumferentially offset from each other when the handle concealing assembly is in the concealing position such that the aperture is circumferentially spaced a distance from the open area when the handle concealing assembly is in the concealing position.

10. The motor vehicle assembly of claim 1, wherein the open area opens radially away from the axis.

11. A method, comprising:

rotating a handle concealing assembly back and forth about an axis between a concealing position that blocks access to a door handle through an aperture in a door body, and a revealing position that permits access to the door handle, the door handle separate from the handle concealing assembly;

when the handle concealing assembly is in the revealing position, at least partially circumferentially aligning an open area provided by the handle concealing assembly about the axis; and when the handle concealing assembly is in the concealing position misaligning the aperture and the open area such that a portion of the handle concealing assembly blocks the aperture, wherein the door handle is a portion of a door body.

12. The method of claim 11, wherein the handle concealing assembly is recessed behind an exterior surface of the door body when in the revealing position and when in the concealing position, wherein, when the handle concealing assembly is in the revealing position, the open area opens laterally outward through the exterior surface.

13. The method of claim 11, wherein the door handle is a downwardly extending flange of the door body.

14. The method of claim 11, further comprising transitioning a door latch from a latched position to an unlatched position in response to detecting a presence of a user.

15. The method of claim 11, further comprising transitioning a door latch from a latched position to an unlatched position in response to detection of an authorized user.

16. The method of claim 11, further comprising rotating the handle concealing assembly from the concealing position to the revealing position in response to detecting a key.

17. The method of claim 11, further comprising receiving part of a hand of a user within the open area when the user is grasping the handle and the handle concealing assembly is in the revealing position.

18. A motor vehicle assembly, comprising:

a vehicle door having an aperture and a door handle; and a handle concealing assembly rotatable about an axis relative to the door handle, the handle concealing assembly rotatable about the axis back and forth between a concealing position that blocks access to the door handle and a revealing position that permits access to the door handle, when in the revealing position, a gap of the handle concealing assembly is circumferentially aligned with the aperture such that a hand of a user has clearance to reach through the aperture and grasp the door handle, when the concealing position, the gap of the handle concealing assembly is circumferentially misaligned with the aperture to block access to the door handle.

* * * * *